US009372058B2

(12) United States Patent
Fritz

(10) Patent No.: US 9,372,058 B2
(45) Date of Patent: Jun. 21, 2016

(54) HOLLOW BULLET WITH INTERNAL STRUCTURE

(71) Applicant: Randy R. Fritz, Bloomsburg, PA (US)

(72) Inventor: Randy R. Fritz, Bloomsburg, PA (US)

( * ) Notice: Subject to any disclaimer, the term of this patent is extended or adjusted under 35 U.S.C. 154(b) by 0 days.

(21) Appl. No.: 14/369,250

(22) PCT Filed: Dec. 28, 2012

(86) PCT No.: PCT/US2012/071892
§ 371 (c)(1),
(2) Date: Jun. 27, 2014

(87) PCT Pub. No.: WO2013/141929
PCT Pub. Date: Sep. 26, 2013

(65) Prior Publication Data

US 2014/0326158 A1 Nov. 6, 2014

Related U.S. Application Data

(60) Provisional application No. 61/580,751, filed on Dec. 28, 2011.

(51) Int. Cl.

| | |
|---|---|
| ***F42B 12/00*** | (2006.01) |
| ***F42B 14/02*** | (2006.01) |
| ***F42B 5/02*** | (2006.01) |
| ***F42B 7/10*** | (2006.01) |
| ***F42B 12/34*** | (2006.01) |
| ***F42B 12/74*** | (2006.01) |

(Continued)

(52) U.S. Cl.
CPC ..... *F42B 14/02* (2013.01); *F42B 5/025* (2013.01); *F42B 7/10* (2013.01); *F42B 12/02* (2013.01); *F42B 12/34* (2013.01); *F42B 12/74* (2013.01); *F42B 12/745* (2013.01); *F42B 30/02* (2013.01)

(58) Field of Classification Search
CPC ..... F42B 5/025; F42B 7/10; F42B 8/12; F42B 8/14; F42B 10/34; F42B 10/48; F42B 12/00; F42B 12/02; F42B 12/22; F42B 12/24; F42B 12/34; F42B 12/367; F42B 12/72; F42B 12/74; F42B 12/745; F42B 12/76; F42B 12/78; F42B 14/02; F42B 30/02
See application file for complete search history.

(56) References Cited

U.S. PATENT DOCUMENTS

| | | | |
|---|---|---|---|
| 549,334 | A | 11/1895 | Smith |
| 594,199 | A | 11/1897 | Field |
| 687,611 | A | 11/1901 | Davis |

(Continued)

FOREIGN PATENT DOCUMENTS

RU 2009118180 A 11/2010

*Primary Examiner* — Gabriel Klein
(74) *Attorney, Agent, or Firm* — The Webb Law Firm

(57) ABSTRACT

A bullet has a cylindrical body portion and a conical tip monolithically formed with the body portion. The bullet is hollowed out to form an internal cavity. A sidewall defines the structure of the body portion and the conical tip. Bullet structure provides for a bore size, low weight, high velocity, and low recoil projectile having a full-bore size that does not have to expand to a larger diameter during firing in order to transfer its energy to a larger wound channel. In one embodiment, a plurality of recesses is provided on the body portion and extends through the sidewall. The recesses are disposed circumferentially in the radial direction and are offset longitudinally along a longitudinal axis of the bullet. The internal cavity includes a plurality of trusses extending in a radial direction. Instead of or in addition to, the trusses, the wall of the internal cavity may include one or more ridges.

19 Claims, 5 Drawing Sheets

(51) Int. Cl.
*F42B 30/02* (2006.01)
*F42B 12/02* (2006.01)

(56) References Cited

U.S. PATENT DOCUMENTS

| | | | | | |
|---|---|---|---|---|---|
| 753,504 | A | | 3/1904 | Meigs et al. | |
| 806,820 | A | | 12/1905 | Meigs et al. | |
| 863,248 | A | | 8/1907 | Zafra | |
| 959,037 | A | * | 5/1910 | Wesson | 102/514 |
| 1,077,564 | A | | 11/1913 | Starkweather | |
| 1,081,616 | A | | 12/1913 | Johnson | |
| 1,084,342 | A | | 1/1914 | Johnson | |
| 1,084,343 | A | | 1/1914 | Johnson | |
| 1,107,722 | A | | 8/1914 | Starkweather | |
| 1,823,022 | A | * | 9/1931 | Blechta | 102/529 |
| 2,792,618 | A | * | 5/1957 | Walker | 86/55 |
| 3,348,486 | A | * | 10/1967 | Rapp | 102/507 |
| 4,245,556 | A | | 1/1981 | Donovan | |
| 4,558,646 | A | * | 12/1985 | Hoffmann et al. | 102/527 |
| 4,655,140 | A | * | 4/1987 | Schirneker | 102/508 |
| 4,770,102 | A | | 9/1988 | Bisping et al. | |
| 4,829,904 | A | | 5/1989 | Sullivan | |
| 4,977,834 | A | * | 12/1990 | Denis | 102/439 |
| 5,025,730 | A | | 6/1991 | Petrovich | |
| 5,069,139 | A | * | 12/1991 | Denis | 102/518 |
| 5,187,325 | A | | 2/1993 | Garvison | |
| 5,789,698 | A | * | 8/1998 | Beal | 102/516 |
| 5,801,324 | A | * | 9/1998 | Pickard | 102/510 |
| 6,161,482 | A | | 12/2000 | Clark | |
| 6,186,072 | B1 | * | 2/2001 | Hickerson et al. | 102/518 |
| 6,439,125 | B1 | * | 8/2002 | Carter | 102/507 |
| 7,966,937 | B1 | | 6/2011 | Jackson | |
| 8,015,924 | B1 | * | 9/2011 | Maines et al. | 102/492 |
| 2003/0089264 | A1 | * | 5/2003 | Eberhart et al. | 102/510 |
| 2004/0000250 | A1 | | 1/2004 | Stratum | |
| 2006/0027131 | A1 | | 2/2006 | Byer | |
| 2007/0017409 | A1 | * | 1/2007 | Mansfield et al. | 102/518 |
| 2007/0204758 | A1 | * | 9/2007 | Spatz et al. | 102/514 |
| 2008/0196616 | A1 | * | 8/2008 | Cziglenyi | 102/439 |
| 2009/0090235 | A1 | | 4/2009 | Brunn | |

* cited by examiner

HOLLOW BULLET WITH INTERNAL STRUCTURE

CROSS-REFERENCE TO RELATED APPLICATIONS

This application is the United States national phase of International Application No. PCT/US2012/071892 filed Dec. 28, 2012, and claims priority to U.S. Provisional Application No. 61/580,751 filed Dec. 28, 2011, the disclosures of which are hereby incorporated in their entirety by reference.

BACKGROUND OF THE INVENTION

1. Field of the Invention

The present invention relates, in general, to an ammunition round for use with rifled or non-rifled barrels, and more particularly, to a hollow bullet adapted for use as a slug projectile.

2. Description of the Related Art

Regardless of whether used in hunting, military, or law enforcement applications, conventional bullets utilize a cartridge structure, where the projectile (or a plurality of projectiles) and its propellant are encased in a single package. The external dimension of a bullet cartridge and/or the projectile is dimensioned such that its outer dimension is nominally the same as the internal diameter of the rifle or gun barrel. This is a necessary design consideration in order to create a seal between the bullet and the barrel for preventing the escape of gas generated by the propellant once it is fired. Most conventional bullets are specifically designed for use with either rifled or non-rifled barrels. Bullets for use in rifled barrels usually have a solid core with a surrounding metal jacket. Typically, the solid core is made from a relatively heavy metal, such as lead, and the jacket is made from a harder material that is capable of withstanding higher temperature, such as copper. In this manner, the copper jacket of the bullet is slightly compressed during its passage down the barrel by the helical grooves in the rifled barrel. The bullet is spun by the grooves to stabilize its flight. Jacketed bullets are capable of withstanding high firing velocities and can achieve high accuracy over long firing ranges.

Certain bullet designs utilized with rifled barrels may have a hollow projectile that has a pit or hollowed-out shape at its tip. Generally, these types of bullets are intended to cause the bullet to fragment upon impact, such that most of the bullet's kinetic energy is expended upon impact. When a bullet of this kind strikes a target, the bullet widens at its tip to increase the frontal surface area of the bullet and limit its depth of penetration. Other collapsible bullet designs have cutout portions which collapse and expand once the bullet strikes a target. Within the prior art, U.S. Pat. Nos. 1,084,342; 1,084,343; and 1,081,616 to Johnson illustrate this type of bullet. These types of bullets feature openings that have portions of the core extruded out and have a tip portion that is prevented from rotational or longitudinal movement until the inner part of the tip near the extruded portions is weakened upon impact to allow for a "mushrooming" effect.

Regardless of whether the firing weapon has a rifled or non-rifled barrel, an important design consideration in making bullets is maximizing the external diameter of the bullet with respect to the inner diameter of the barrel without creating excessive friction during firing. A considerable amount of energy created by the propellant being fired is lost through the friction of the bullet as it travels through the barrel. The friction generates a significant amount of heat and exerts a tremendous pressure on the bullet as it travels through the barrel. One solution for coping with the high temperature and pressure is to use a metal jacket that is capable of withstanding these factors. While this solution is easily applicable to bullets having a solid internal core, it is less practical for use with bullets having a hollow internal structure. In such case, the high pressure exerted on the bullet is sufficient to deform the portions between the hollowed spaces, regardless of whether a metal jacket is used. A bullet that is deformed after it exits the weapon barrel is subject to unpredictable aerodynamics, which reduces its accuracy. Moreover, a bullet that is deformed while traveling within the weapon barrel can often cause internal damage to the helical grooves in the barrel or, at worst, cause the barrel to bulge or burst.

Within the art of shotgun-fired ammunition, conventional shotgun slug designs are typically based on a solid lead core positioned within a plastic shell casing. The interior of the shell casing is filled with powder and buffer material. In some embodiments, the solid lead core may be positioned within a sabot. Conventional shotgun slugs do not have a hollow internal structure.

With reference to FIG. 1, a hollow bullet 10 in accordance with a prior art embodiment is shown. Bullet 10 has a cylindrical body portion 20 and a conical tip 30 monolithically formed with body portion 20. Conical tip 30 may have a pointed terminal surface 40. Alternatively, the conical tip 30 may terminate at a blunt surface. A recess 50 is provided on conical tip 30 and extends through the entire conical tip 30 to form a hollow internal cavity 60. Internal cavity 60 is entirely void of any structure extending across its interior. Such bullet design is described in U.S. Pat. Nos. 1,084,342; 1,084,343; 1,081,616, all to Johnson.

A major disadvantage of such design is that the high pressure exerted on bullet 10 during firing is sufficient to deform conical tip 30. This collapses the recess 50 and deforms the bullet 10 before it exits the barrel and occurs regardless of whether a metal jacket is used. As noted above, bullet 10 that is deformed after it exits the weapon barrel is subject to unpredictable aerodynamics, which reduces its accuracy. Moreover, bullet 10 that is deformed while traveling within the weapon barrel can often cause internal damage to the helical grooves in the barrel or, at worst, cause the barrel to bulge or burst.

It will readily be appreciated by those skilled in the art that the problems associated with existing bullet designs with hollow internal structure call for a solution that is not readily available within the prior art.

SUMMARY OF THE INVENTION

In view of the foregoing, a need exists for an ammunition round having a hollow bullet structure with an internal support structure that eliminates the problems commonly associated with prior hollow bullet designs. A further need exists in the art for an ammunition round having a hollow bullet structure that is adapted for use as a slug projectile. An additional need exists for providing an ammunition round that is easy and cost-efficient to manufacture and achieves superior firing characteristics compared to conventional designs.

As described in detail herein, an ammunition round for use with a weapon having a rifled barrel may include a cartridge having a generally cylindrical form including a closed bottom portion, an open top portion, and a cartridge sidewall extending circumferentially therebetween. The ammunition round may further include a primer provided at the terminal end of the closed bottom portion for interacting with a firing pin of a weapon. A powder charge may fill at least a portion of an interior of the cartridge between the open top portion and the closed bottom portion. The ammunition round may further include a bullet provided at the open top portion of the cartridge, the bullet enclosing the open top portion of the cartridge. The bullet may include a hollow, cylindrical body portion and a conical tip monolithically formed with the body portion. The body portion and the conical tip may define an internal cavity. The cylindrical body portion may include a recessed portion extending radially inward into a sidewall of the cylindrical body portion to reduce an area of contact between the bullet and a barrel of a weapon. The ammunition round may further include a truss filling at least a portion of the internal cavity to reinforce the internal cavity of the bullet. The truss may be formed from a polymeric material. A part of the cylindrical body portion that extends past the recessed portion may form a driving band. A leading edge of the driving band proximate to the conical tip transitions into a radius of the conical tip.

In another embodiment, a bullet for use with a weapon having a barrel may include a hollow, cylindrical body portion and a conical tip monolithically formed with the body portion. The body portion and the conical tip may define an internal cavity. A plurality of recesses may be provided on at least one of the body portion and the conical tip. The plurality of recesses may extend at least partially through a sidewall of the bullet. In addition, at least one truss may extend radially across the internal cavity. The recesses may disposed circumferentially in the radial direction of the bullet and are offset longitudinally along a longitudinal axis of the bullet. In one embodiment, the plurality of recesses may extend fully through the sidewall of the bullet. In another embodiment, the plurality of recesses may be disposed circumferentially in a radial direction of the body portion and are offset longitudinally along a central axis of the bullet. The at least one truss may include a plurality of spokes extending radially outward from a central portion to the interior portion of the sidewall. The bullet may further include at least one ridge extending radially inward within the internal cavity from a central axis of the bullet. The at least one ridge may be located in a transition portion between the body portion and conical tip. A bottom end of the body portion of the bullet opposite the conical tip may be enclosed. The conical tip may terminate at a pointed tip.

According to one embodiment of the invention, a bullet may include a hollow, cylindrical body portion and a conical tip monolithically formed with the body portion, such that the body portion and the conical tip define an internal cavity. The cylindrical body portion may include a recessed portion extending radially inward into a sidewall of the cylindrical body portion to reduce an area of contact between the bullet and a barrel of a weapon. The bullet may further include a truss filling at least a portion of the internal cavity to reinforce the internal cavity of the bullet. The truss may be formed from a polymeric material. A part of the cylindrical body portion that extends past the recessed portion may form a driving band. A leading edge of the driving band proximate to the conical tip transitions into a radius of the conical tip.

The ammunition round may be adapted for use with a weapon having a rifled or non-rifled barrel. In an embodiment where the ammunition round is adapted for use with a rifled barrel, the bullet desirably has a pointed conical tip and is crimped along the open top portion of the cartridge such that the pointed conical tip protrudes from the cartridge. In an embodiment where the ammunition round is adapted for use with a firearm with a tubular magazine where one round is loaded against the base of another, the bullet desirably has a flattened tip and is crimped along the open top portion of the cartridge such that the flattened tip does not protrude from the cartridge.

Further details and advantages of the present invention will become apparent from the following detailed description read in conjunction with the drawings.

DETAILED DESCRIPTION OF THE INVENTION

For purposes of the description hereinafter, spatial orientation terms, as used, shall relate to the referenced embodiment as it is oriented in the accompanying drawing figures or otherwise described in the following detailed description. However, it is to be understood that the embodiments described hereinafter may assume many alternative variations and configurations. It is also to be understood that the specific components, devices, and features illustrated in the accompanying drawing figures and described herein are simply exemplary and should not be considered as limiting.

Figure 1:
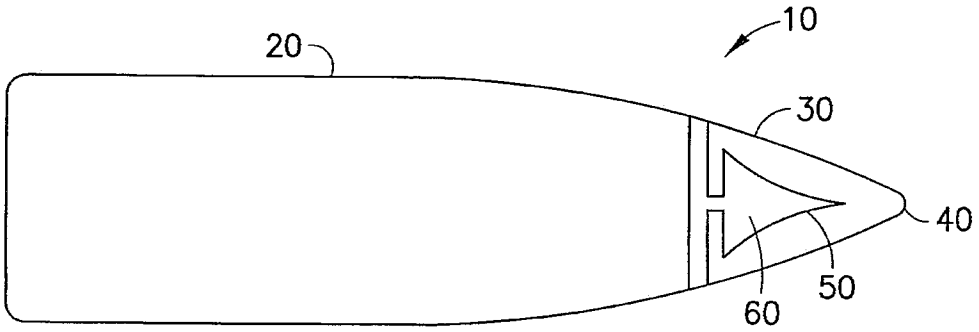
FIG. 1 PRIOR ART
FIG. 1 shows a side view of a hollow bullet according to a prior art embodiment.
Figure 2:
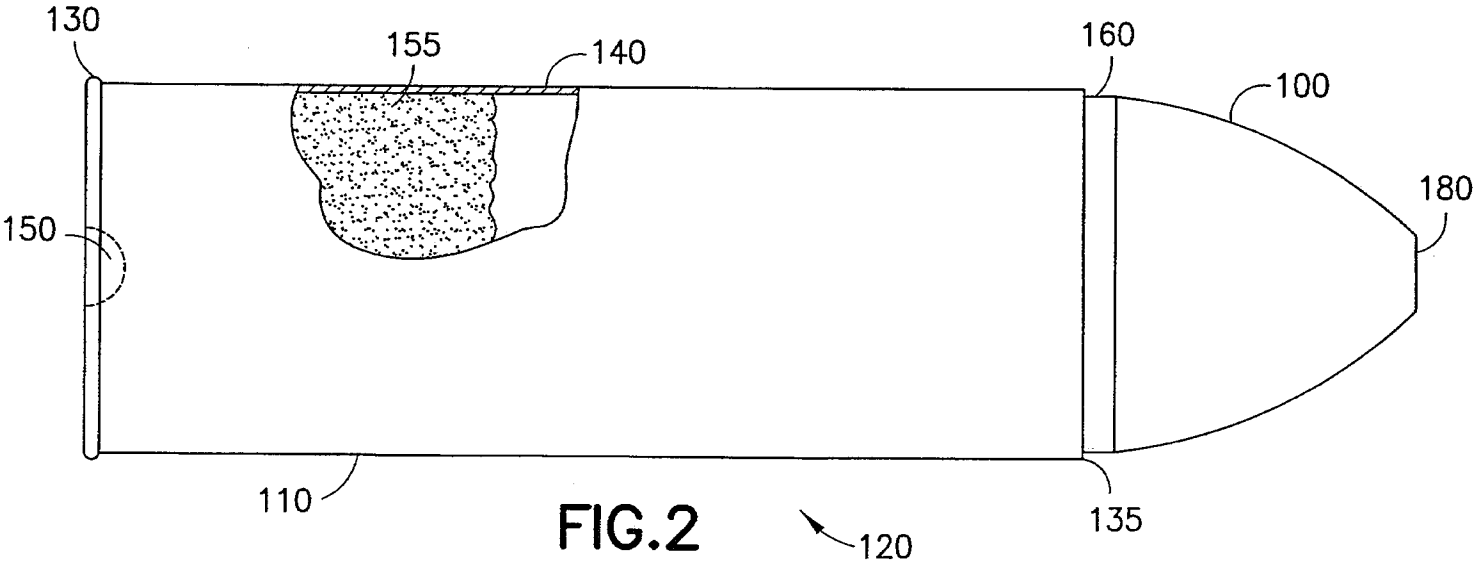
FIG. 2 is a side view of a bullet and a corresponding cartridge in accordance with an embodiment of the present invention.

Referring to the drawings in which like reference characters refer to like parts throughout the several views thereof, an embodiment of a hollow bullet is generally described hereinafter. Referring to FIG. 2, a bullet 100 and a corresponding cartridge 110 are shown in accordance with an embodiment of the present invention. Bullet 100 and its corresponding cartridge 110 constitute a single ammunition round 120. In this embodiment, ammunition round 120 is adapted for use with a weapon having a rifled or non-rifled barrel in a single-shot or a stacked-round magazine configuration. Cartridge 110 has a generally cylindrical form including a closed bottom portion 130, an open top portion 135, and a cartridge sidewall 140 extending circumferentially therebetween. In this embodiment, cartridge 110 is desirably constructed from a metallic material, or a specially-formulated plastic material. A primer 150 is located at the terminal end of closed bottom portion 130 for interacting with a firing pin of a weapon (not shown). The interior of cartridge 110 is filled with a charge 155 in form of a powder. Bullet 100 is provided on open top portion 130 such that the cartridge 110 encloses at least part of the bullet 100 and forms round 120.

Figure 3:
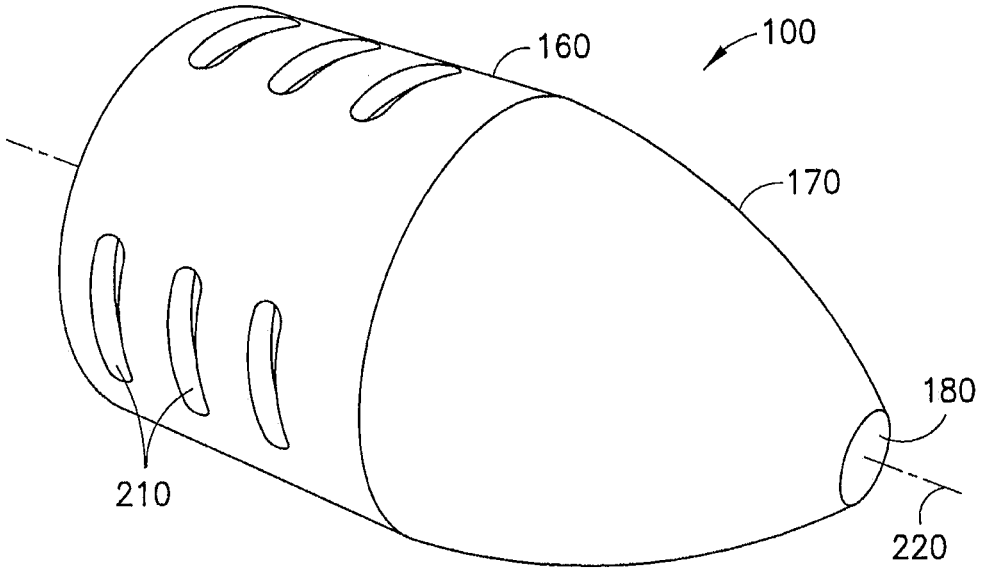
FIG. 3 is a perspective view of the bullet illustrated in FIG. 2, shown without the corresponding cartridge.
Figure 4:
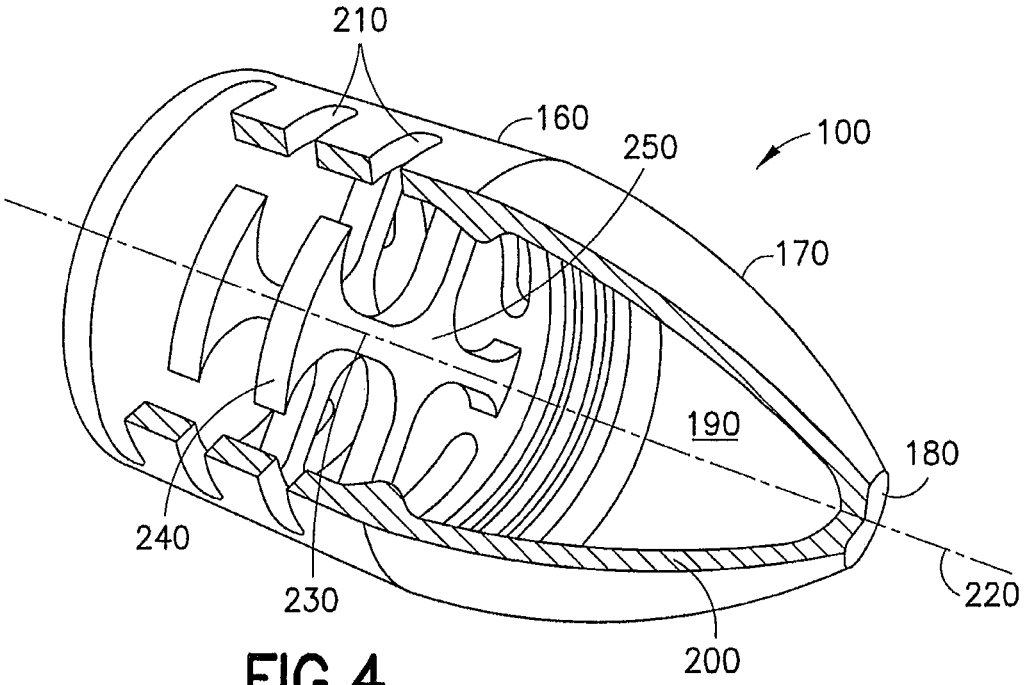
FIG. 4 is a perspective view of the bullet shown in FIG. 2, showing part of the bullet cut away from the bullet body.
Figure 5:
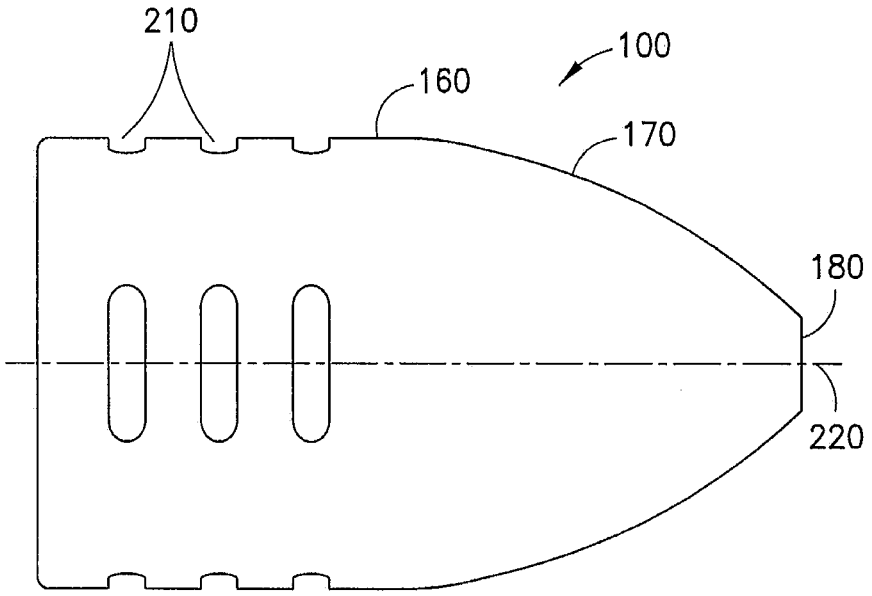
FIG. 5 is a side view of the bullet shown in FIG. 2.

With reference to FIGS. 3-5, bullet 100 is shown without the corresponding cartridge. Bullet 100 has a cylindrical body portion 160 and a conical tip 170 monolithically formed with body portion 160. Conical tip 170 may have a blunt terminal surface 180. Alternatively, the conical tip 170 may terminate at a point. The interior of body portion 160 and conical tip 170 is hollowed out to form an internal cavity 190. A sidewall 200 having a uniform thickness defines the structure of body portion 160 and conical tip 170. In another embodiment, sidewall 200 may have a non-uniform thickness. A plurality of recesses 210 is provided on body portion 160 and extends through the entire thickness of sidewall 200. In another embodiment of bullet 100, recesses 210 extend only partially through the thickness of sidewall 200. In such embodiment, recesses 210 may extend from the outside of bullet 100 toward internal cavity 190, or from internal cavity toward the exterior side of bullet 100. One or more recesses 210 are disposed circumferentially in the radial direction of body portion 160 and are offset longitudinally along a central axis 220 of bullet 100. While the recesses 210 illustrated in FIGS. 3-5 are shown as extending in a direction perpendicular to longitudinal axis 220, one or more recesses 210 may be angled with respect to longitudinal axis 220. In another embodiment of bullet 100, one or more recesses 210 may be disposed circumferentially in the radial direction of body portion 160, with radially offset patterns in the longitudinal direction of body portion 160. In some embodiments, one or more recesses 210 may be provided in a randomly distributed arrangement on bullet 100.

With reference to FIG. 4, internal cavity 190 of bullet 100 includes a plurality of trusses 230. Each truss 230 extends in a radial direction across internal cavity 190 of bullet 100. While FIG. 4 shows trusses 230 as extending radially inward from an interior portion of the sidewall 200, in an alternate embodiment, trusses may extend radially outward from an exterior portion of the sidewall 200. Additionally, each truss 230 may extend across the entire internal cavity 190 or across a portion thereof. Trusses 230 may extend in a direction perpendicular to longitudinal axis 220, as illustrated in the figures. Alternatively, trusses 230 may extend in a direction that is angled with respect to longitudinal axis 220. Each truss 230 includes a plurality of spokes 240 extending radially outward from a central portion 250 to interior portion of sidewall 200. Areas between spokes 240 are hollow to minimize the weight of bullet 100. Transition portions between individual spokes 240 and central portion 250 or interior portion of sidewall 200 may be rounded. FIG. 4 illustrates the spokes 240 being connected to interior portion of sidewall 200 between recesses 210 in the radial direction. Alternatively, spokes 240 may be connected to interior portion of sidewall 200 at a location between recesses in the longitudinal direction. In some embodiments, the number of trusses 230 corresponds to the number of rows of recesses 210 in the longitudinal direction of bullet 100. Optionally, bottom portion of bullet 100 opposite the conical tip 170 may be enclosed.

Trusses 230 reinforce the structure of bullet 100 such that it can withstand firing through a barrel of a weapon without being collapsed. Various conventional bullet calibers can be adapted for use with trusses 230 described herein. For example, bullet 100 can be adapted for use with small caliber weapons, such as handguns and light rifles, or large caliber weapons, such as gas or grenade guns or light artillery. Exemplary caliber size may range, without limitation, from .17 to .95. Regardless of caliber size and use in military, hunting, or law enforcement applications, bullet 100 desirably has one or more trusses 230 to reinforce the structure of the bullet body.

Figure 6:
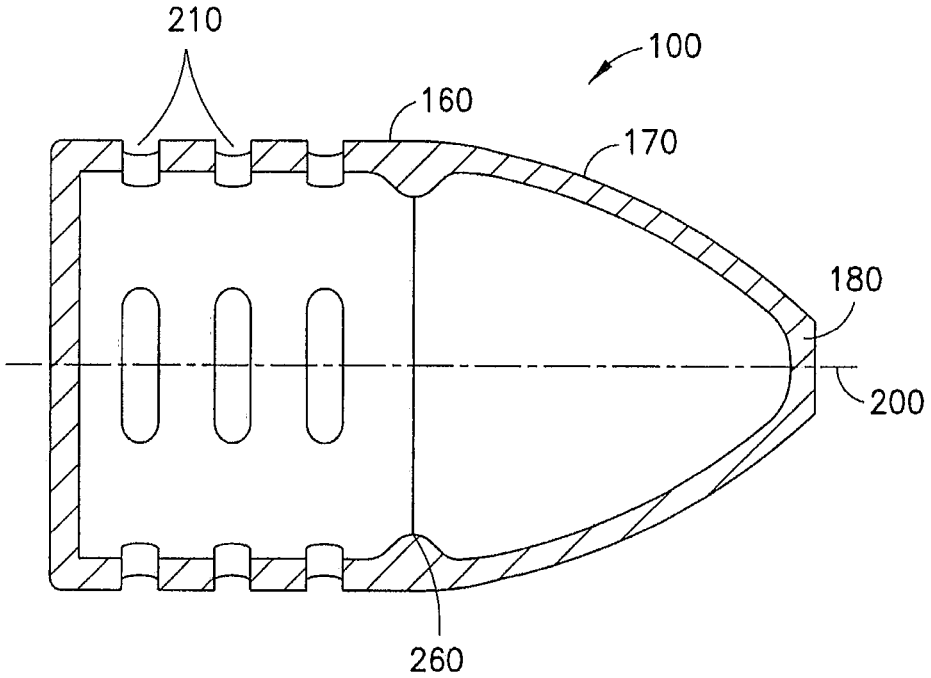
FIG. 6 is a perspective view of a bullet in accordance with another embodiment of the present invention, showing part of the bullet cut away from the bullet body.

With reference to FIG. 6, another embodiment of bullet 100 is illustrated. In this embodiment, bullet 100 has an identical external structure to the bullet illustrated in FIGS. 2-5. However, bullet 100 shown in FIG. 6 includes an internal ridge 260 extending circumferentially within an internal cavity. Ridge 260 extends radially inward from the interior portion of the sidewall such that a thicker sidewall profile is created at the location of ridge 260. Ridge 260 is illustrated in FIG. 6 as being located forward of the plurality of recesses 210 closer to the conical tip of bullet 100. Alternatively, ridge 260 may be provided between the rows of recesses 210 in the longitudinal direction of bullet 100, or in any other location within the internal cavity. One or more ridges 260 may be provided inside the internal cavity. For example, bullet 100 may have one or more ridges 260 located in a transition portion between cylindrical body portion 160 and conical tip 170 (distal end), one or more ridges 260 between the rows of recesses 210, and one or more ridges located at a proximal end of the cylindrical body portion. This embodiment may or may not include the trusses 230 shown in FIG. 4.

Figure 7:
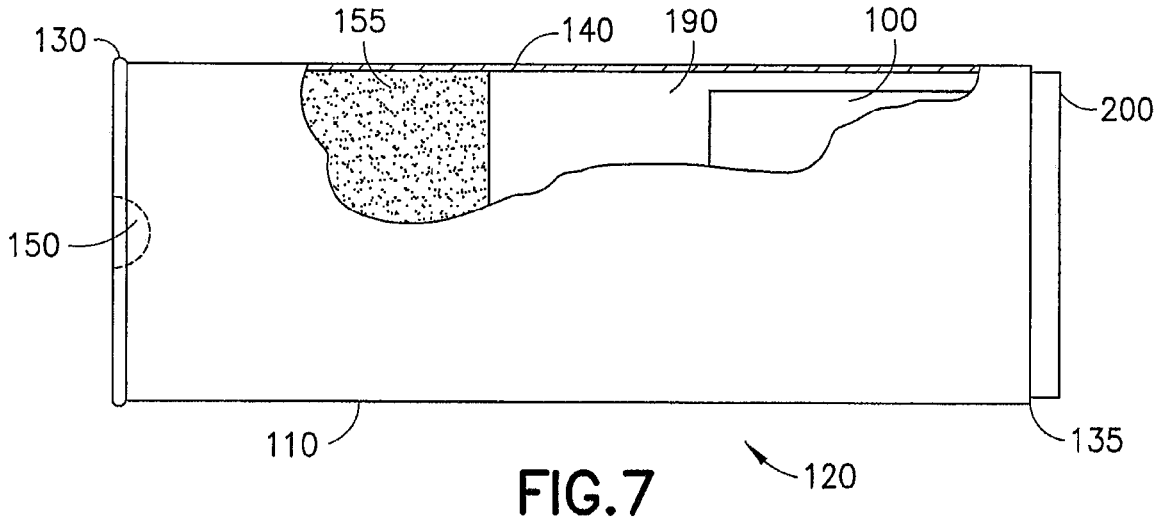
FIG. 7 is a side view of a bullet and a corresponding cartridge in accordance with another embodiment of the present invention.
Figure 8:
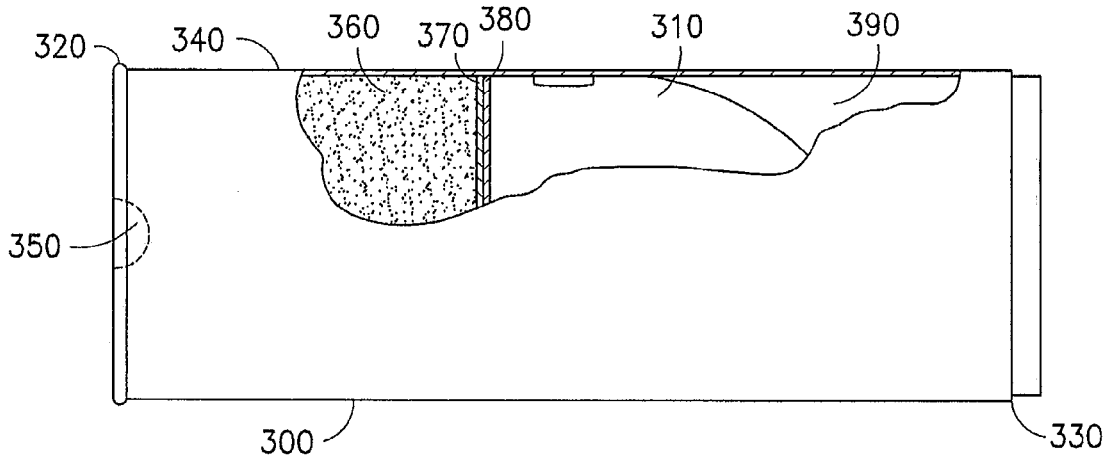
FIG. 8 is a side view of a bullet and a corresponding cartridge in accordance with another embodiment of the present invention.

Referring to FIGS. 7-8, alternate embodiments of bullet 100 and its corresponding cartridge 110 are shown. In these embodiments, ammunition round 120 is adapted for use with a weapon having a non-rifled barrel, such as a shotgun. With reference to FIG. 7, cartridge 110 has a generally cylindrical form including a closed bottom portion 130, an open top portion 135, and a cartridge sidewall 140 extending circumferentially therebetween. In this embodiment, cartridge 110 may be constructed from a plastic material. A primer 150 is located at the terminal end of closed bottom portion 130 for interacting with a firing pin of a weapon (not shown). The interior of cartridge 110 is filled with a charge 155 in the form of a powder. Bullet 100 is provided on open top portion 135 such that the cartridge 110 encloses substantially all of bullet 100. A filler material 190 optionally may be disposed between charge 155 and bullet 100. Open top portion 130 includes a crimped section 200 to enclose bullet 100 before ammunition round 120 is fired. After firing, bullet 100 forces open the crimped section 200.

With reference to FIG. 8, a cartridge 300 for use with a bullet 310 in accordance with another embodiment is illustrated. Cartridge 300 has a generally cylindrical form including a closed bottom portion 320, an open top portion 330, and a cartridge sidewall 340 extending circumferentially therebetween. In this embodiment, cartridge 300 may be constructed from a plastic material. A primer 350 is located at the terminal end of closed bottom portion 320 for interacting with a firing pin of a weapon (not shown). The interior of cartridge 300 is filled with a charge 360 in form of a powder. Bullet 310 is provided on open top portion 330 such that the cartridge 300 encloses substantially all of bullet 310. A gas seal 370 and a spacer 380 are provided between charge 360 and bullet 310. Gas seal 370 and spacer 380 provide a surface for the expanding gases to push after charge 360 is ignited. A filler material 390 optionally may be disposed between charge 360 and bullet 310. Open top portion 330 includes a crimped section 400 to enclose bullet 310 before an ammunition round is fired. After firing, bullet 310 forces open the crimped section 400.

Figure 9:
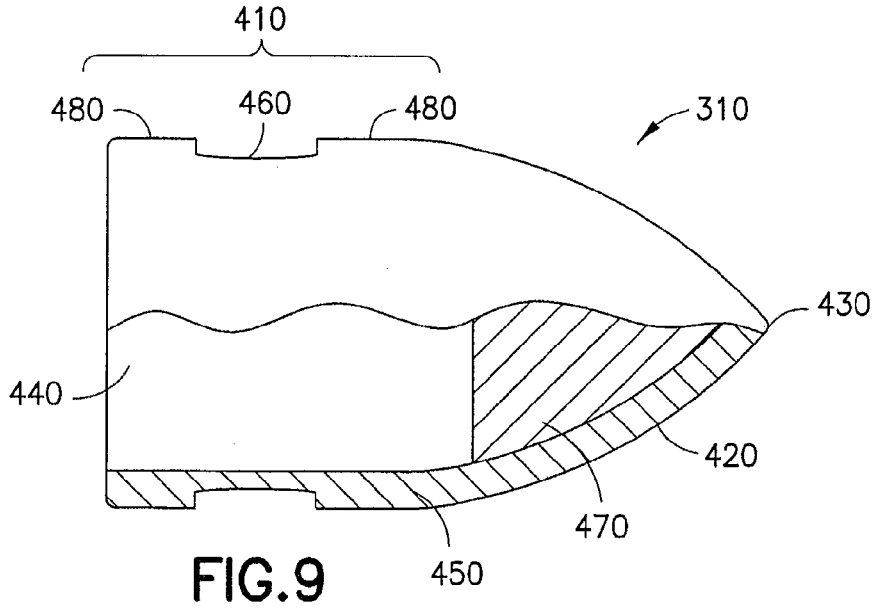
FIG. 9 is a side view of a bullet in accordance with another embodiment of the present invention.

Referring to FIG. 9, another embodiment of bullet 310 is shown without the corresponding cartridge 300 shown in FIG. 8. Bullet 310 has a cylindrical body portion 410 and a conical tip 420 monolithically formed with body portion 410. Conical tip 420 may have a pointed terminal surface 430. Alternatively, the conical tip 420 may terminate at a blunt end (not shown). The interior of body portion 410 and conical tip 420 is hollowed out to form an internal cavity 440. A sidewall 450 defines the structure of body portion 410 and conical tip 420. Interior cavity 440 may be filled with a truss 470 formed from, for example, a polymeric material to at least partially fill internal cavity 440. Truss 470 reinforces sidewall 450 from collapsing when bullet 310 is fired. In another embodiment, truss 470 may be made from a metallic material.

With continuing reference to FIG. 9, body portion 410 includes a recessed portion 460 extending into sidewall 450 of body portion 410. Recessed portion 460 is slightly undercut compared to an external diameter of body portion 410 to reduce friction of bullet 310 as it travels through the barrel upon firing. A part of body portion 410 that extends past recessed portion 460 forms a driving band 480 that forms a reinforcing truss structure that may contact the gun barrel as bullet 310 travels through the barrel. A leading edge of driving band 480 proximate to conical tip 420 transitions into the radius of conical tip 420.

Bullet 100, 310 can be used as a frangible configuration, where limited bullet impact is required. For example, bullet 100, 310 may be adapted for use on ships and planes, where the bullet must be capable of impacting a person without piercing the fuselage. In such embodiments, bullet 100 may disintegrate into a plurality of fragments or may flatten upon impact.

Having described the construction of the bullet in accordance with one embodiment of the present invention, a method of manufacturing bullet 100, 310 will now be described. Bullet 100, 310 may be manufactured from a metallic or plastic material of sufficient material strength to withstand being fired through a barrel of a weapon. Various manufacturing techniques may be utilized to manufacture bullet 100, 310. For example, bullet 100, 310 may be machined from a solid block of material. In some embodiments, internal cavity 190, 440 of bullet 100, 310 may be machined, cast, forged, or manufactured in a similar manner, while one or more trusses in bullet 100 may be glued or welded inside internal cavity 190 between recesses 210. In other embodiments, bullet 100, 310 may be manufactured using a 3D printing technique by laying down successive layers of material. For example, bullet 100, 310 may be made from bronze or a brass alloy. Other non-limiting examples of materials from which bullet 100, 310 may be made include a stainless steel-bronze matrix, a tungsten-copper matrix, a copper bronze-matrix, and iron-copper matrix. For high-powered rounds, it is desirable to construct bullet 100, 310 from a material having sufficient hardness to prevent warping due to high firing forces. In certain embodiments, a copper-washed layer may be added to add lubricity for lower friction within the barrel. In embodiments where bullet 100, 310 is made from a non-metallic material, an exemplary material exhibiting good lubricity and mechanical strength properties is polytetrafluoroethylene (PTFE), commonly known as TEFLON®.

While various embodiments of the hollow bullet were provided in the foregoing description, those skilled in the art may make modifications and alterations to these embodiments without departing from the scope and spirit of the invention. For example, it is to be understood that, to the extent possible, one or more features of any embodiment can be combined with one or more features of any other embodiment. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A bullet for use with a weapon having a barrel, the bullet comprising:

a hollow, cylindrical body portion;

a conical tip monolithically formed with the body portion, the body portion and the conical tip defining an internal cavity;

a plurality of recesses provided on at least one of the body portion and the conical tip, the plurality of recesses extending at least partially through a sidewall of the bullet; and at least one truss extending radially across a portion of the internal cavity from an interior portion of the sidewall, wherein the at least one truss includes a plurality of spokes extending radially outward from a central longitudinal axis of the internal cavity to an interior portion of the sidewall, the plurality of spokes separated by empty hollow spaces extending through a full thickness of the at least one truss, wherein the recesses are disposed circumferentially in the radial direction of the bullet and are offset longitudinally along a longitudinal axis of the bullet, wherein the at least one truss has an upper surface facing the conical tip and a lower surface opposite the upper surface, and wherein the sidewall of the bullet is thickened in a location of the at least one truss.

2. The bullet of claim 1, wherein the plurality of recesses extends fully through the sidewall of the bullet.

3. The bullet of claim 1, wherein the plurality of recesses are disposed circumferentially in a radial direction of the body portion and are offset longitudinally along a central axis of the bullet.

4. The bullet of claim 1, further comprising at least one ridge extending radially inward within the internal cavity toward a central axis of the bullet.

5. The bullet of claim 4, wherein the at least one ridge is located in a transition portion between the body portion and conical tip.

6. The bullet of claim 1, wherein a bottom end of the body portion opposite the conical tip is enclosed.

7. The bullet of claim 1, wherein the conical tip terminates at a pointed tip.

8. A bullet for use with a weapon having a barrel, the bullet comprising:

a hollow, cylindrical body portion;

a conical tip monolithically formed with the body portion, the body portion and the conical tip defining an internal cavity; and at least one truss extending radially across a portion of the internal cavity from an interior portion of a sidewall of the bullet, wherein the at least one truss includes a plurality of spokes extending radially outward from a central longitudinal axis of the internal cavity to an interior portion of the sidewall, the plurality of spokes separated by empty hollow spaces extending through a full thickness of the at least one truss, wherein the cylindrical body portion includes a recessed portion extending radially inward into an outer portion of the sidewall of the cylindrical body portion to reduce an area of contact between the bullet and a gun barrel, wherein the at least one truss has an upper surface facing the conical tip and a lower surface opposite the upper surface, and wherein the sidewall of the bullet is thickened in a location of the at least one truss.

9. The bullet of claim 8, wherein the at least one truss fills at least a portion of the internal cavity to reinforce the internal cavity of the bullet.

10. The bullet of claim 9, wherein the at least one truss is formed from a polymeric material.

11. The bullet of claim 8, wherein a part of the cylindrical body portion that extends past the recessed portion forms a driving band.

12. The bullet of claim 11, wherein a leading edge of the driving band proximate to the conical tip transitions into a radius of the conical tip.

13. The bullet of claim 8, wherein the conical tip terminates at a pointed tip.

14. An ammunition round for use with a weapon having a barrel, the ammunition round comprising:

a cartridge having a generally cylindrical form including a closed bottom portion, an open top portion, and a cartridge sidewall extending circumferentially therebetween;

a primer provided at the terminal end of the closed bottom portion for interacting with a firing pin of a weapon;

a powder charge filling at least a portion of an interior of the cartridge between the open top portion and the closed bottom portion; and a bullet provided at the open top portion of the cartridge, the bullet comprising:

a hollow, cylindrical body portion;

a conical tip monolithically formed with the body portion, the body portion and the conical tip defining an internal cavity; and at least one truss extending radially across a portion of the internal cavity from an interior portion of a sidewall of the bullet, wherein the at least one truss includes a plurality of spokes extending radially outward from a central longitudinal axis of the internal cavity to an interior portion of the sidewall, the plurality of spokes separated by empty hollow spaces extending through a full thickness of the at least one truss, wherein the cylindrical body portion includes a recessed portion extending radially inward into an outer portion of the sidewall of the cylindrical body portion to reduce an area of contact between the bullet and a barrel of a weapon, wherein the at least one truss has an upper surface facing the conical tip and a lower surface opposite the upper surface, and wherein the sidewall of the bullet is thickened in a location of the at least one truss.

15. The ammunition round of claim 14, wherein the at least one truss fills at least a portion of the internal cavity to reinforce the internal cavity of the bullet.

16. The ammunition round of claim 15, wherein the at least one truss is formed from a polymeric material.

17. The ammunition round of claim 14, wherein a part of the cylindrical body portion that extends past the recessed portion forms a driving band.

18. The ammunition round of claim 14, wherein a leading edge of the driving band proximate to the conical tip transitions into a radius of the conical tip.

19. The ammunition round of claim 14, wherein the conical tip terminates at a pointed tip.

* * * * *